US005701717A

United States Patent [19]

Gutknecht

[11] Patent Number: 5,701,717

[45] Date of Patent: Dec. 30, 1997

[54] ASSEMBLY OF A LOADING MEANS AND A STRIP STACKER

[75] Inventor: Heinz Gutknecht, Epe, Netherlands

[73] Assignee: VMI Epe Holland B.V., Netherlands

[21] Appl. No.: 763,422

[22] Filed: Dec. 11, 1996

[30] Foreign Application Priority Data

Dec. 11, 1995 [NL] Netherlands ..... 1001866

[51] Int. Cl.[6] ..... B65B 63/04

[52] U.S. Cl. ..... 53/117; 53/116; 493/411; 493/414

[58] Field of Search ..... 53/117, 245, 259, 53/116; 414/285, 788.1; 493/411, 413, 414, 415

[56] References Cited

U.S. PATENT DOCUMENTS

| | | | |
|---|---|---|---|
| 2,250,572 | 7/1941 | Cumfer | 493/415 X |
| 2,679,964 | 6/1954 | Farmwald | 53/116 X |
| 3,599,393 | 8/1971 | Read | 53/116 X |
| 3,735,554 | 5/1973 | Maggio | 493/415 X |
| 3,917,250 | 11/1975 | Branick | 53/116 X |
| 4,716,706 | 1/1988 | Boeckmann . | |
| 5,007,623 | 4/1991 | Unkuri et al. | 493/415 X |
| 5,423,733 | 6/1995 | Adachi | 493/414 |

FOREIGN PATENT DOCUMENTS

| | | |
|---|---|---|
| 2 328 556 | 5/1977 | France . |
| 1 170 362 | 5/1964 | Germany . |
| 34 22 352 | 12/1985 | Germany . |

*Primary Examiner*—Daniel Moon

*Attorney, Agent, or Firm*—Pennie & Edmonds LLP

[57] ABSTRACT

Assembly of a loading means with a horizontal loading surface and a strip stacker for depositing an unvulcanized rubber strip on the loading surface. The strip stacker containing a depositing mechanism with a depositing end and with a pair of conveyor belts for transporting a rubber strip vertically between the conveying belts to the depositing end and a feed conveyor for transporting a rubber strip to the depositing mechanism in a transport direction. The feed conveyor has an input end and an output end. The loading means is provided with means for variably adjusting the distance between the depositing end and the loading surface. The depositing mechanism is provided with means for moving recriprocably in one direction the depositing end with regard to the loading surface. The strip stacker is provided with means for moving the output end of the feed conveyor substantially transverse to the transport direction.

6 Claims, 4 Drawing Sheets

ASSEMBLY OF A LOADING MEANS AND A STRIP STACKER

TECHNICAL FIELD

The invention relates to an assembly of a loading means with a horizontal loading surface and a strip stacker for depositing an non-vulcanized rubber strip on the loading surface, the strip stacker containing a depositing mechanism with a depositing end and with a pair of conveyor belts for transporting a rubber strip vertically between the conveying belts to the depositing end and a feed conveyor for transporting a rubber strip to the depositing mechanism in a transport direction, the feed conveyor having an input end and an output end, the loading means being provided with means for variably adjusting the distance between the depositing end and the loading surface, the depositing mechanism being provided with means for moving reciprocally in one direction the depositing end with regard to the loading surface.

The invention further relates to a strip stacker for use in a suchlike assembly.

BACKGROUND OF THE INVENTION

In the rubber processing industry rubber material is generally manufactured in one place and processed into an end product in another. Consequently, the rubber material has to be transported from one place to the other. This takes place for example by processing the rubber material into a rubber strip, and stacking this rubber strip onto a pallet by means of a strip stacker with a depositing mechanism which has a depositing end. In most cases the pallet is a box pallet with a horizontal loading surface on the circumference of which vertical partitions have been placed. The loading surface is reciprocally moved in one direction with regard to the depositing end of the depositing mechanism, which is moved in a direction perpendicular to the movement of the loading surface in order to stack the rubber strip on the box pallet. In most cases the depositing end is formed by the exit opening of two suspended conveyor belts moving as a pendulum and located parallel to each other. After the filled pallet has been transported elsewhere, the rubber strip is pulled out of the box pallet. In practice, however, it has been shown that because this known assembly of loading means and strip stacker the fill ratio or load ratio of a box pallet is not optimal. Moreover, removing the rubber strip from the box pallet or the pallet can cause difficulties as the stacked rubber strip can get tangled up. The latter hampers a far-reaching, automatic, mechanical processing of the rubber strip. Furthermore, an exact synchronisation of the two different reciprocating movements is only possible with difficulty and at a considerable cost.

SUMMARY OF THE INVENTION

It is an object of the invention to provide an assembly of a loading means and a strip stacker, in which the stacking up of the rubber strip on the loading surface is compact, in other words achieving a high fill or load ratio, which prevents tangling in the stacked rubber strip, and which solves the synchronisation problem in a simple way.

For this purpose an assembly as set out above is characterized according to the invention in that the strip stacker is provided with means for moving the output end of the feed conveyor substantially transverse to the transport direction. The invention is based on the insight that all the problems mentioned above occur in the known assembly because synchronisation between the reciprocating movements of the depositing end and the loading surface does not in all cases remain exact and even when depositing on just one loading surface is prone to undesired variations. On the contrary, by reciprocally moving the output end of the feed conveyor according to the invention, a rubber strip is placed in a zigzag fashion between the two conveyor belts. For depositing this rubber strip on the loading surface only the deposit end has to be reciprocally moved and not the loading surface. In this way not only an optimal stacking, that is an optimal fill or load ratio, without tangling, is obtained, but, in addition, an exact synchronisation between the reciprocating movement is realized in a more simple and cheaper way.

An embodiment of the assembly according to the invention is characterized in that the means for moving the output end of the feed conveyor are means for rotating the feed conveyor about the input end. In this way the output end can be moved in a mechanically simple way, compared to moving the whole feed conveyor, for example.

If the means for moving the output end of the feed conveyor and the feed conveyor itself are driven by one common drive, an extremely exact synchronisation between both reciprocating movements can be realized.

According to the invention a strip stacker with a depositing mechanism for use in an assembly according to the invention is obtained, which strip stacker is characterized in that the strip stacker is provided with means for moving the output end of the feed conveyor substantially transverse to the transport direction and thus enabling a compact and controlled stacking of a rubber strip on a loading means.

BRIEF DESCRIPTION OF THE DRAWINGS

By way of example an embodiment of an assembly and strip stacker according to the invention will now be described on the basis of the drawing. In the drawing.

DETAILED DESCRIPTION OF THE INVENTION

Figure 1:
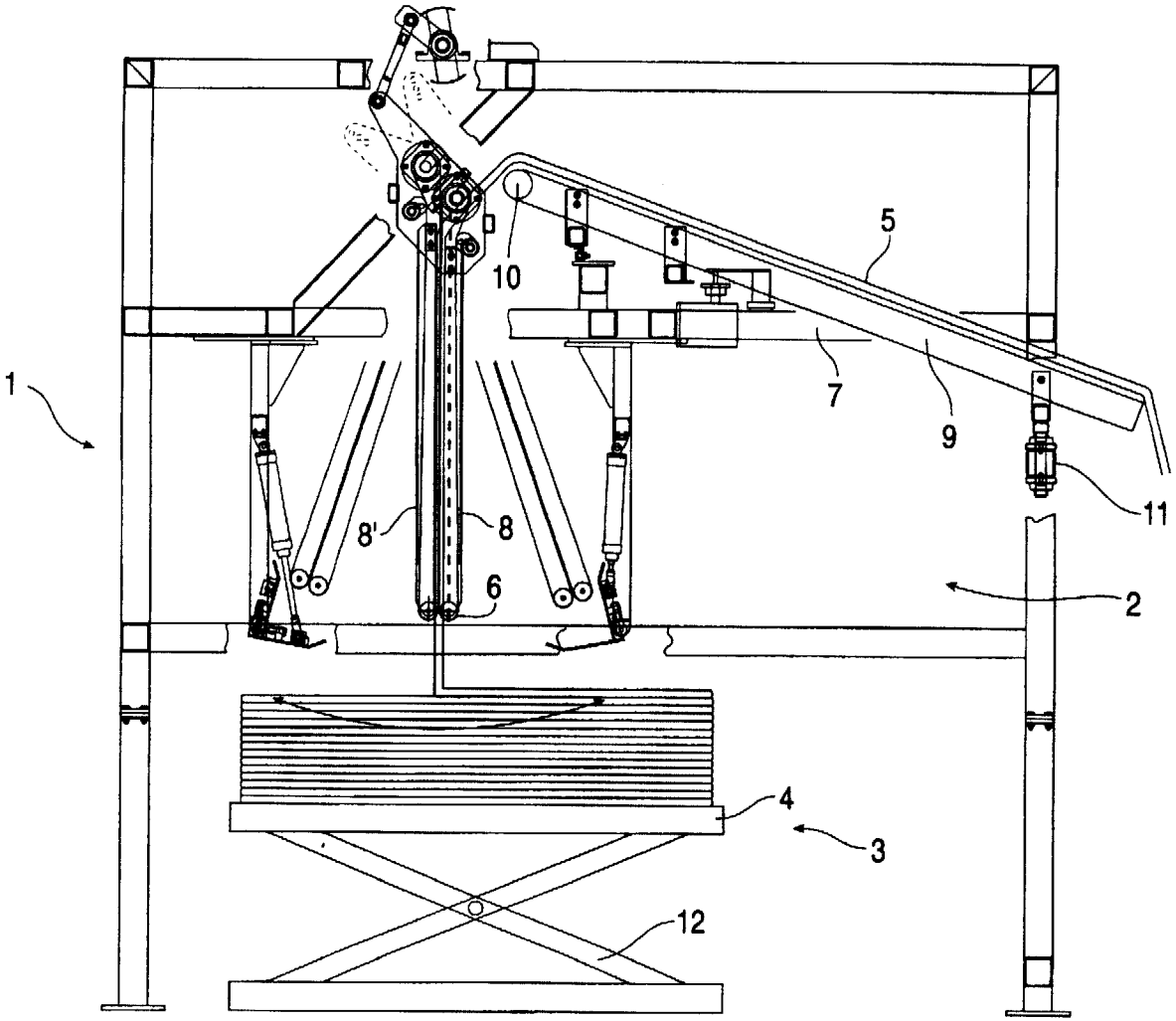
FIG. 1 schematically shows an assembly according to the invention in side view.
Figure 2:
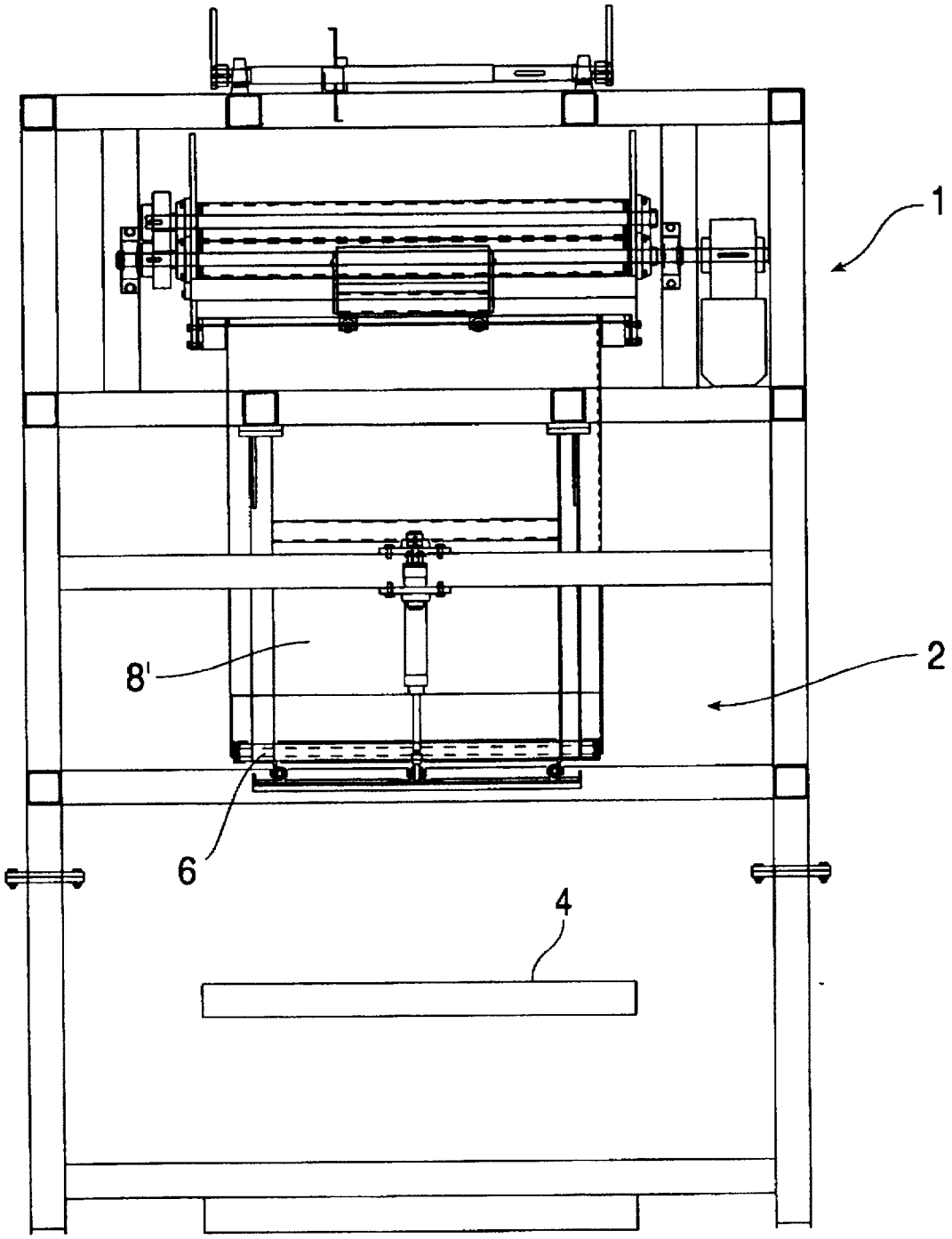
FIG. 2 schematically shows the assembly of FIG. 1 in front view.

In FIG. 1 an assembly 1 for depositing a rubber strip 5 according to the invention is shown in side view. The assembly 1 contains a loading means 3 and a strip stacker 2. The loading means 3 is provided with a horizontal loading surface 4, and can be a pallet, a box pallet with upright partitions or any other loading means. In the embodiment shown the loading means 3 is a pallet. The strip stacker 2 contains a depositing mechanism for the rubber strip 5 provided with a depositing end 6.

The rubber strip 5, which is not vulcanized and, as it is generally stacked immediately after having been manufactured, is approximately 5° C. to 10° C. warmer that the surroundings, is fed to two conveyor belts 8, 8' over a feed conveyor 7 in a transport direction. The feed conveyor 7 has an input end 9 and an output end 10. The strip stacker 2 is provided with means 11 for moving the output end 10 in a direction perpendicular to the transport direction. The rubber strip 5 is clamped slide-free in a zigzag fashion between the conveyor belts 8, 8' by the reciprocating movement. In this way the zigzag shape of the rubber strip 5 is retained (FIG. 6). The conveyor belts 8, 8' are preferably commonly driven by one drive.

By means of a lifting means 12, the loading surface 4 of the loading means 3 is placed up to a specified distance from the depositing end 6. When the rubber strip reaches the depositing end 6, the depositing end 6 is reciprocally moved horizontally in one direction by the common swinging of the conveyor belts 8, 8', so that the rubber strip 5 is deposited on the loading surface. When reversing the direction of movement, the distance between the depositing end 6 and the layer of rubber strip deposited on the loading surface is adjusted each time so as to obtain a controlled and guided stacking of the rubber strip. For this purpose the lifting means 12 is moved downwards each time. When the stacked rubber strip has reached the desired height, the strip stacker is turned off and the rubber strip is cut off.

Thus the rubber strip is stacked in a compact and controlled way so that removing the rubber strip form the loading means again can take place without problems, for instance without tangling.

The assembly of loading means and strip stacker can be provided with sensors which detect the position of the rubber strip and the loading means, with which the movements of the loading means and the velocities of the conveyor belts can be controlled, depending on the detected position.

In the embodiment described above, adjusting the distance between depositing end and loading surface is realized by vertically moving the loading surface. It will, however, be clear that for this purpose the depositing end can also be vertically moved, or depositing end and loading surface together.

The pair of conveyor belts 8, 8' used in the embodiment described above, is formed by conveyor belts in order to obtain an optimal contact surface with the rubber strip, so that during the vertical transport of the rubber strip the rubber strip is clamped well between the conveyor belts. Preferably both conveyor belts 8, 8' are driven by a common drive which engages one of the driving rolls of each conveyor belt. Along with the use of conveyor belts, the use of roller, grate or chain transport of rubber strips is also possible.

Flattening the rubber loops of the rubber strip that is placed in a zigzag fashion on the loading surface can be carried out by a separate flattening means.

In order to be able to realize an exact synchronisation between the reciprocating movement of the conveyor belts 8, 8' and the reciprocating movement of the output end 10 of the feed conveyor 7 in a simple way, the means 11 for reciprocally moving the depositing end 10 and the feed conveyor 7 itself are driven by a common drive, for example an a.c. motor. An exact synchronisation, and consequently a correct deposition of a rubber strip on a loading surface, can then be realized by adjusting the velocity of the feed conveyor 7 to the velocity of the conveyor belts 8, 8'.

Figure 3:
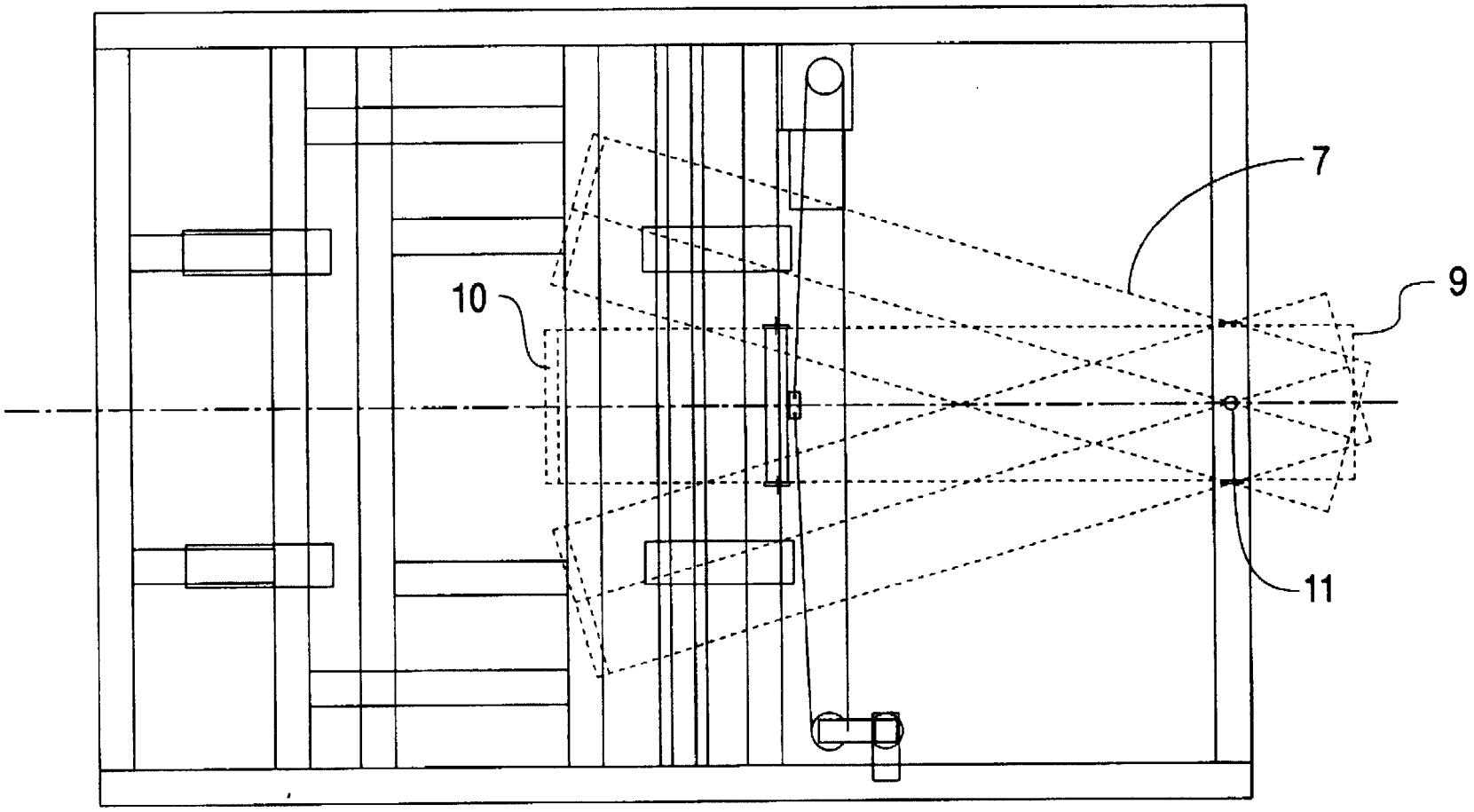
FIG. 3 schematically shows a top view of an assembly according to the invention, FIG. 4 schematically shows an example of the use of an assembly according to the invention, and FIG. 5 schematically shows another example of the use of an assembly according to the invention.

The reciprocating movement of the output end 10 of the feed conveyor 7 can be realized in a mechanically simple way if the means 11 for moving the output end 9 are means such as a driven rotary shaft which rotate the feed conveyor 7 about the input end 9. In an alternative, but mechanically more complex way, the means 11 for moving the output end 10 would be able to move the whole feed conveyor 7 transverse to the direction of transport. In FIG. 3 some positions of the feed conveyor 7 are shown in broken lines, which can be arrived at by rotating the feed conveyor 7 about a driven rotary shaft 11.

Figure 4:
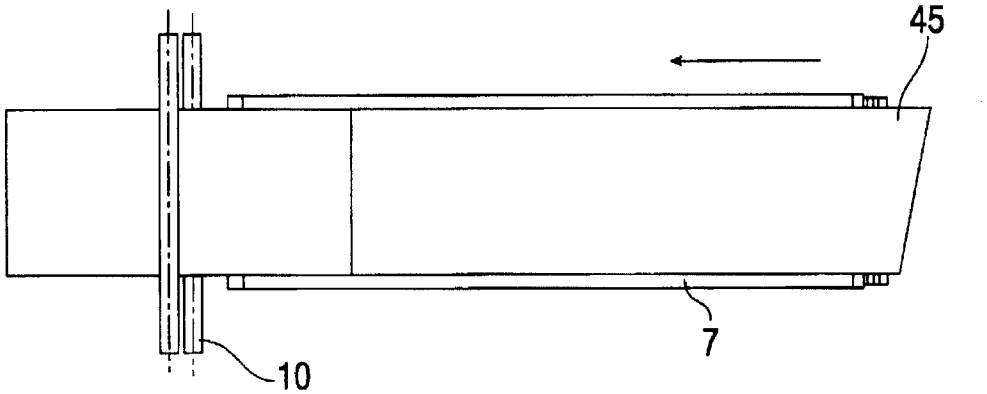
Figure 5:
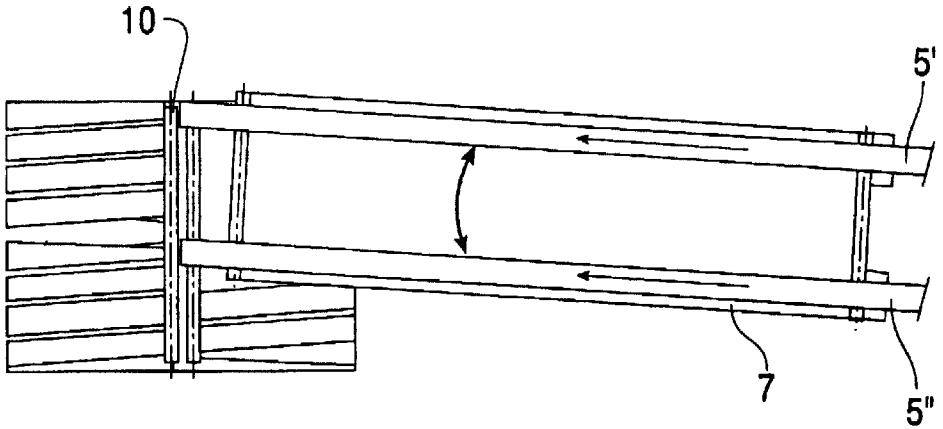

Apart from the manner described above, the strip stacker 2 according to the invention can be used in various other ways. When stopping the reciprocating movement of the feed conveyor 7 it is therefore possible to deposit a wide rubber strip 45 as shown in FIG. 4. In addition, two or more narrower rubber strips may be deposited on a non-swinging feed conveyor 7. It is, however, also possible to deposit two or more narrower rubber strips 5', 5" by means of a swinging feed conveyor 7, as is shown schematically in FIG. 5.

I claim:

1. Assembly comprising:

a feed conveyor having an input end and an output end for transporting an unvulcanized rubber strip in a transport direction;

a strip stacker comprising a depositing mechanism having a receiving end for receiving the unvulcanized rubber strip from the feed conveyor, a depositing end and a pair of conveyor belts for transporting the unvulcanized rubber strip vertically therebetween from the receiving end to the depositing end, the depositing mechanism being provided with means for reciprocally moving the depositing end;

loading means with a horizontal loading surface for receiving the unvulcanized rubber strip from the depositing end of the depositing mechanism, said loading means being provided with means for variably adjusting the distance between the depositing end and the loading surface; and means for moving the output end of the feed conveyor substantially transversely across the transport direction.

2. Assembly according to claim 1, wherein the means for moving the output end of the feed conveyor are means for rotating the feed conveyor about the input end.

3. Assembly according to claim 1 or 2, wherein the means for moving the output end of the feed conveyor and the feed conveyor itself are driven by one common drive.

4. Assembly according to claim 2, wherein the feed conveyor is substantially rotatably fixed about a point at the input end of the feed conveyor.

5. Assembly according to claim 1, wherein the strip stacker is provided with means for moving the output end of the feed conveyor substantially transversely across the transport direction.

6. Assembly comprising:

a feed conveyor having an input end and an output end for transporting an unvulcanized rubber strip in a transport direction;

a strip stacker comprising a depositing mechanism having a receiving end for receiving the unvulcanized rubber strip from the feed conveyor, a depositing end and a pair of conveyor belts for transporting the unvulcanized rubber strip vertically therebetween from the receiving end to the depositing end, the depositing mechanism being provided with means for reciprocably moving the depositing end;

a loading means with a horizontal loading surface for receiving the unvulcanized rubber strip from the depositing end of the depositing mechanism, said loading means being provided with means for variably adjusting the distance between the depositing end and the loading surface; and a means for moving the output end of the feed conveyor substantially transversely across the transport direction by rotating the feed conveyor about a substantially fixed point at the input end thereof.

* * * * *